United States Patent [19]

Ayer

[11] 4,241,972

[45] Dec. 30, 1980

[54] PANEL MOUNT FOR ELECTRICAL CONNECTOR

[75] Inventor: George E. Ayer, Naperville, Ill.

[73] Assignee: Bunker Ramo Corporation, Oak Brook, Ill.

[21] Appl. No.: 952,762

[22] Filed: Oct. 19, 1978

Related U.S. Application Data

[63] Continuation of Ser. No. 809,993, Jun. 27, 1977, abandoned.

[51] Int. Cl.[3] ..... H01R 13/627

[52] U.S. Cl. ..... 339/126 R; 248/27.3; 339/134

[58] Field of Search ..... 339/17 C, 125 R, 126 R, 339/128, 134, 91 R, 75 R, 75 M; 248/27.3, 222.4, 223.1–223.4; 24/207

[56] References Cited

U.S. PATENT DOCUMENTS

| | | | |
|---|---|---|---|
| 945,049 | 1/1910 | Russell | 339/126 R |
| 1,197,470 | 9/1916 | Feldman et al. | 339/127 R |
| 1,662,422 | 3/1928 | Hodges | 220/18 |
| 1,664,684 | 4/1928 | Helgeby | 362/282 |
| 2,093,038 | 9/1937 | Douglas | 248/27 |
| 2,096,319 | 5/1937 | Churchill | 248/223 |
| 2,118,665 | 5/1938 | Churchill | 248/223 |
| 2,169,708 | 8/1939 | O'Callaghan | 24/213 |
| 2,605,806 | 8/1952 | Tinnerman | 151/41.75 |
| 2,618,998 | 11/1952 | Poupitch | 85/37 |
| 2,703,662 | 3/1955 | Meyer | 220/3.6 |
| 2,757,353 | 7/1956 | Opalenik et al. | 339/128 |
| 2,765,397 | 10/1956 | Harris | 240/51.11 |
| 2,770,435 | 11/1956 | Becker | 248/27 |
| 2,790,961 | 4/1957 | Delcamp | 339/128 |
| 2,794,962 | 6/1957 | Donato | 339/128 |
| 2,798,271 | 7/1957 | Flora | 24/73 |
| 2,800,698 | 7/1957 | Wood | 24/81 |
| 2,811,328 | 10/1957 | Ericson | 248/27 |
| 2,871,324 | 1/1959 | Budd | 201/55 |
| 2,938,190 | 5/1960 | Krehbiel | 339/176 |
| 2,946,033 | 7/1960 | Wirth | 339/17 |
| 2,956,215 | 10/1960 | Andrea | 339/17 C X |
| 3,041,570 | 6/1962 | Simerl | 339/36 |
| 3,052,865 | 9/1962 | Pappano et al. | 339/126 |
| 3,091,679 | 5/1963 | Norden | 200/168 |
| 3,134,467 | 5/1964 | Blyth | 189/35 |
| 3,168,612 | 2/1965 | Sorenson | 174/57 |
| 3,176,260 | 3/1965 | Pascucci | 339/128 |
| 3,193,226 | 7/1965 | Showalter | 248/27 |
| 3,209,141 | 9/1965 | Nieder-Westermann | 240/51.11 |
| 3,232,566 | 2/1966 | Eisenberg | 248/27 |
| 3,273,104 | 9/1966 | Krol | 339/128 |
| 3,278,145 | 10/1966 | Leshuk | 248/27 |
| 3,279,727 | 10/1966 | Buttriss | 248/27 |
| 3,279,729 | 10/1966 | Buttriss | 248/27 |
| 3,289,145 | 11/1966 | Ruehlemann et al. | 339/176 |
| 3,318,558 | 5/1967 | Buttriss | 248/27 |
| 3,365,694 | 1/1968 | Parker | 339/17 |
| 3,368,780 | 2/1968 | Buttriss | 248/27 |
| 3,398,390 | 8/1968 | Long | 339/91 |
| 3,402,384 | 9/1968 | Murakami et al. | 339/128 |
| 3,409,859 | 11/1968 | Krehbiel | 339/91 |
| 3,430,188 | 2/1969 | Leach | 339/128 |
| 3,432,802 | 3/1969 | Ritchie | 339/128 |
| 3,446,467 | 5/1969 | Bailey et al. | 248/27 |
| 3,459,396 | 8/1969 | Buttriss | 248/27 |
| 3,489,890 | 1/1970 | Anderson et al. | 240/51.11 |
| 3,514,743 | 5/1970 | Schantz | 339/128 |
| 3,523,269 | 8/1970 | Witer et al. | 339/91 |
| 3,533,045 | 10/1970 | Henschen | 339/17 |
| 3,544,951 | 12/1970 | Roberts | 339/91 |
| 3,575,370 | 4/1971 | Morris et al. | 248/201 |
| 3,588,083 | 6/1971 | Callanan | 269/98 |
| 3,613,177 | 10/1971 | Davis | 24/73B |
| 3,614,713 | 10/1971 | Heath | 339/128 |
| 3,620,401 | 11/1971 | Lund | 220/3.6 |
| 3,651,446 | 3/1972 | Sadogierski et al. | 339/91 R |
| 3,662,321 | 5/1972 | Bury | 339/92 M |
| 3,753,212 | 8/1973 | Yamada et al. | 339/91 R |
| 3,790,915 | 2/1974 | Dugan et al. | 339/88 R |
| 3,790,923 | 2/1974 | Mathe | 339/128 |
| 3,793,613 | 2/1974 | Reichert | 339/126 R |
| 3,801,953 | 4/1974 | Lynch | 339/65 |
| 3,812,450 | 5/1974 | Simovits et al. | 339/128 |
| 3,824,552 | 7/1974 | Kirby | 339/128 |
| 3,838,380 | 9/1974 | Stieler | 339/14 R |
| 3,942,226 | 3/1976 | Barnett et al. | 24/208 A |
| 3,958,857 | 5/1976 | Schultz et al. | 339/128 |
| 3,989,343 | 11/1976 | Lucius et al. | 339/128 |
| 3,995,947 | 12/1976 | Lightner et al. | 339/92 M |
| 4,006,872 | 2/1977 | Tanner | 248/77.1 |
| 4,025,142 | 5/1977 | Huber | 339/128 |
| 4,029,385 | 6/1977 | Mysiak et al. | 339/128 |
| 4,046,449 | 9/1977 | Ranzanigo | 339/126 R |
| 4,077,693 | 3/1978 | Briel et al. | 339/126 R |

| | | | |
|---|---|---|---|
| 4,095,870 | 6/1978 | Mathe | 339/75 M X |
| 4,113,179 | 9/1978 | McKee | 339/91 R |
| 4,113,337 | 9/1978 | McKee | 339/91 R |
| 4,124,267 | 11/1978 | Mines et al. | 339/125 R |

FOREIGN PATENT DOCUMENTS

| | | | |
|---|---|---|---|
| 2628617 | 1/1977 | Fed. Rep. of Germany | 339/128 |

*Primary Examiner*—Mark Rosenbaum
*Assistant Examiner*—Eugene F. Desmond
*Attorney, Agent, or Firm*—F. M. Arbuckle; J. R. Hoffman

[57] ABSTRACT

An electrical connector assembly for mounting an electrical connector to an associated apertured panel board, the electrical connector having a pair of outwardly extending flanges at opposite ends thereof, and the assembly including a pair of connector clips for releasably securing the connector to the panel. Each clip comprises a body member having first and second spaced-apart engagement surfaces disposed in facing relationship to define a mounting slot therebetween, the body member being received through the aperture in the panel so that the engagement surfaces extend along the inner and outer surfaces of the panel to grip the panel therebetween. The body member has a mounting surface spaced from the first engagement surface to receive and hold one of the flanges on the electrical connector, and has spaced-apart abutment shoulders to limit movement of the connector in a predetermined direction. Retaining fingers are carried by the abutment shoulders for snap-in retention of the flange. With the connector body in the opening the clips cannot move relative to the apertured panel board while the connector is held to the clips by the snap-in retention fingers.

8 Claims, 5 Drawing Figures

PANEL MOUNT FOR ELECTRICAL CONNECTOR

This application is a continuation of Ser. No. 809,993, filed June 27, 1977, now abandoned.

BACKGROUND OF THE INVENTION

This invention is directed generally to an electrical connector assembly and is more particularly concerned with a snap-in type construction especially suitable for mounting an electrical connector onto an apertured support panel.

In the data and communication industries there is extensive use of panel boards which have a plurality of terminal posts or other means of connection extending therefrom for connecting the associated circuitry with other equipment.

Mounting of an electrical connector to a panel board frequently is accomplished by the use of screws, such form of connection being labor intensive and uneconomical. Moreover, the metal screws do not electrically isolate the connector from the panel board and may, if improperly installed, create an undesired electrical condition.

Snap-in electrical connector assemblies have been provided which eliminate the use of screws, as, for example, the type disclosed in U.S. Pat. No. 3,958,857 issued to Schultz et al, but in this connector assembly the snap-in clip configuration is integrally secured to the connector and cannot be used with connectors of different sizes or shapes; moreover, if the fasteners are damaged, the entire connector becomes useless. Other types of retainer clips for mounting electrical apparatus have been disclosed, as, for example, in U.S. Pat. No. 3,176,260 issued to Pascucci, but in that case the clip requires a specially formed aperture in order to prevent rotation of the clip relative to the aperture; also the clip disclosed therein may only be used with a single size connector and aperture.

Another form of electrical connector mounting assembly is that illustrated in U.S. Pat. No. 3,790,923 issued to Mathe, and assigned to the same assignee as the present application. The configuration of the connector in that case is considerably more complicated and requires cooperable structure formed on the connector portion in order to achieve the releasable locking mechanism.

SUMMARY OF THE INVENTION

The present invention is directed to an electrical connector assembly including means for simply, efficiently and releasably securing an electrical connector to an apertured support panel, and wherein this is accomplished without the need of special tools or screws.

The connector assembly of the present invention includes connector clips capable of manual assembly onto an apertured support panel and an electrical connector assembled with the clips in a manner which secures the clips in position on the panel and also which releasably locks the connector to the clips. The entire assembly is secured to the underlying support panel in a manner intended to prevent accidental disconnection of the assembly from the panel.

The connector clip for securing the electrical connector to the associated support panel generally comprises a body member having first and second spaced-apart engagement surfaces disposed generally in facing relationship with each other to define a panel mounting slot therebetween. The body member is adapted to be received through an aperture in the support panel with the first and second engagement surfaces respectively extending along the inner and outer surfaces of the support panel in a predetermined direction for gripping the support panel in the slot defined therebetween. The body member also has a mounting surface which provides an area for receiving and holding a complementary flange of the associated electrical connector. A pair of spaced-apart abutment shoulders project from the mounting surface and serve to prevent movement of the associated electrical connector in the plane of the panel when the connector flange is juxtaposed with the mounting surface and within the cavity defined by the abutment shoulders. Inherently resilient retaining means are carried by the abutment shoulders for releasably securing the flange of the connector to the mounting surface whereby snap-in retention of the connector to the connector clips is achieved. The connector clips are separate from the associated connector and may be used any number of differently sized connectors and panel apertures. In addition, the clips are identical in shape and size and may be mass produced very simply and economically.

BRIEF DESCRIPTION OF THE DRAWINGS

The novel features which are believed to be characteristic of the present invention are set forth with particularity in the appended claims. The invention, together with further objects and advantages thereof, can best be understood with reference to the following description taken in connection with the accompanying drawings, in which:

DESCRIPTION OF THE PREFERRED EMBODIMENT

Figure 1:
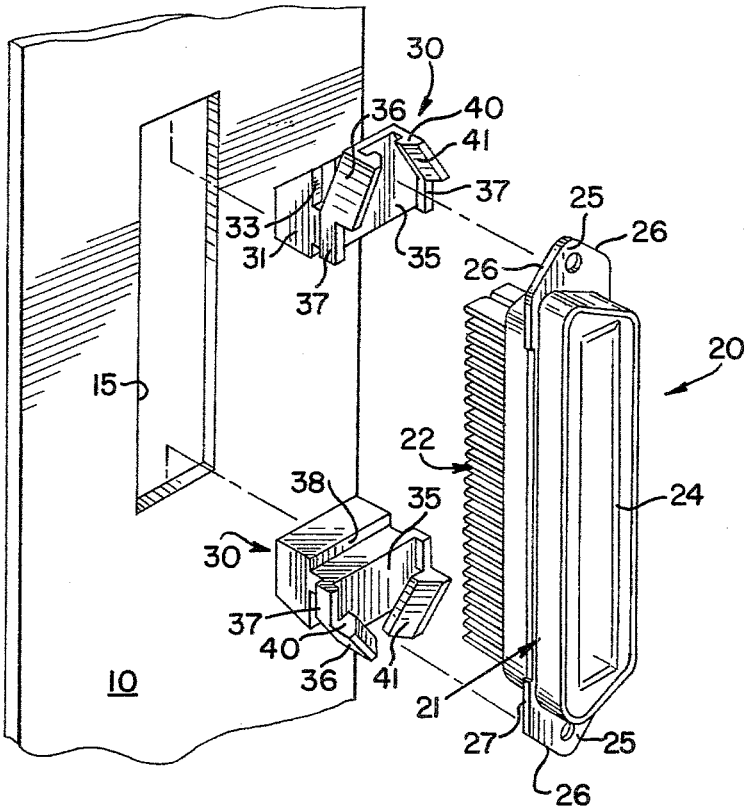
FIG. 1 is an enlarged exploded perspective view of the electrical connector assembly constructed in accordance with and embodying the features of the present invention, and illustrated with reference to an associated apertured panel board.

The electrical connector assembly of the present invention includes an electrical connector designated generally by the numeral 20 cooperable with a pair of connector slips designated generally by the numeral 30, the clips serving to releasably mount the electrical connector 20 on an associated apertured panel board 10 without the use of tools or screws or other fastening means. The panel board 10 includes inner and outer surfaces 13 and 14 respectively and, in many instances, a plurality of preformed apertures 15 therein (one only being shown).

The electrical connector 20 includes a main body portion 21 generally complementary in shape to the preformed aperture 15 in the panel board. The connector 20 further includes a rear contact portion 22 carrying a plurality of individual contact elements 23, which, when the connector 20 is mounted upon the panel board 10, terminate with suitable insulated conductors, not shown, to provide an electrical circuit.

Figure 3:
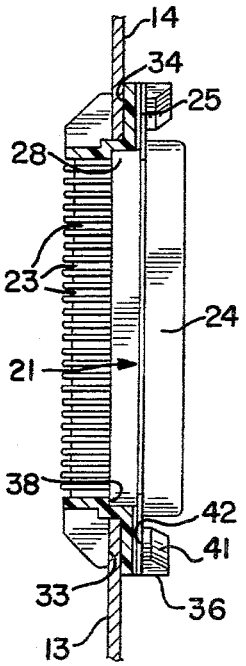
FIG. 3 is an enlarged view in vertical section taken along the line 3—3 in FIG. 2.
Figure 4:
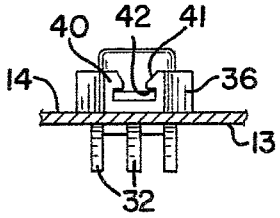
FIG. 4 is an enlarged end view taken along the line 4—4 in FIG. 2.
Figure 5:
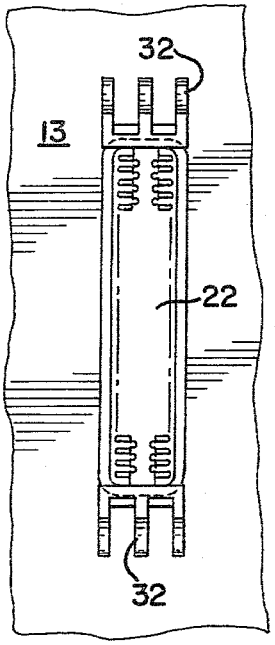
FIG. 5 is an enlarged rear elevational view of the connector assembly of the present invention, illustrating the assembly from the inside of the panel board.

One form of connector 20 with which the present invention is particularly useful is that sold by applicant's assignee as its 157-Series Micro-Pierce Connector. Such connector usually includes a pair of identically shaped apertured mounting flanges 25 formed on the opposite ends thereof, each of the mounting flanges 25 including angled side portions 26 which extend part way around the periphery of the main body portion and terminate in parallel side flange portions 27. The typical connector 20 further includes a shoulder portion 28 along the lower main body portion from which the rear contact portion 22 extends, as best seen in FIG. 3. Finally, the connector further includes a front portion 24 adapted to connect with other complementary multiple contact connectors by appropriate and well-known means.

In accordance with the present invention, the electrical connector 20 is removably mounted upon the panel board 10 by means of the novel connector clips 30. Each connector clip 30 includes a body member 31 having first and second spaced-apart engagement surfaces 33 and 34 disposed generally in facing relationship with each other and which define a panel mounting slot therebetween.

As best illustrated in FIGS. 1 and 3, the connector clip 30 is adapted to be received through the aperture 15 in the associated support panel 10 with the first and second engagement surfaces 33 and 34 respectively extending along the inner and outer surfaces 13 and 14 of the support panel in the slot defined between the engagement surfaces 33 and 34. Each connector clip 30 will be captivated or retained on the panel 10 by pushing the clips in the predetermined direction relative to the support panel such that the slot defined between the engagement surface accepts the panel therebetween.

Figure 2:
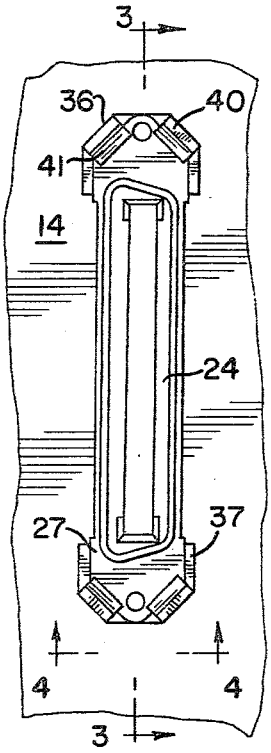
FIG. 2 is an end elevational view of the electrical connector assembly as mounted on a panel board, illustrating the assembly from the outside, or insertion side, of the panel board.

The body member 31 further includes a mounting surface 35 for receiving and holding the complementary shaped flange 25 of the connector 20. A first pair of spaced-apart abutment shoulders 36 project outwardly from the mounting surface, as best seen in FIGS. 1 and 2; the first pair of abutment shoulders 36 being disposed at an angle complementary to the angled portions 26 of the mounting flange 25. By virtue of this angled relationship, it should be apparent that the abutment shoulders 36 serve to prevent movement of the connector 20 in the plane of panel when the flanges 25 thereof are juxtaposed with the mounting surfaces 35 and within the cavity defined by the abutment shoulders 36.

In the preferred embodiment illustrated, the first engagement surface 33 is provided by a plurality of parallel and spaced-apart retaining arms 32 integrally formed with the body member 31 and spaced laterally across the width of the clip 30. When the clip is mounted on the panel board, the arms 32 cooperate to provide a stabilized retaining condition with the second engagement surface 34 which overlies the outer surface 14 of the panel board. The body member 31 may also include a second pair of oppositely disposed and parallel abutment shoulders 37 positioned on the periphery of the mounting surface 35. The second pair of shoulders 37 are disposed at an angle to the first pair of shoulders 36 and parallel to the parallel side portions 36 of the mounting flange 25, to thereby further preclude movement of the flange 25 in a lateral direction relative to said mounting surface.

Carried by the abutment shoulders 36 and integrally formed therewith are retaining fingers 40, each pair of fingers cooperating to releasably secure the flange 25 of the connector 20 to the mounting surface 35. Each of the retaining fingers 40 includes a camming surface 41 thereon and a locking surface 42 disposed beneath the camming surface 41.

The clip preferably is formed of a dielectric material, such as for example polypropylene, which serves to electrically insulate the connector 20 from the panel board 10. Moreover, the nature of such material will render the abutment shoulders 36 inherently resilient and, by virtue of the configuration of the camming surfaces 41, a snap-in locking arrangement is provided for securing the mounting flange 25 of the connector 20 to the mounting surface 35 of the clip 30. When a flange 25 is pressed against the retaining fingers 40 the camming surfaces 41 will bias the shoulders 36 outwardly until the flange 25 passes below the locking surfaces 42, after which the shoulders 36 snap back to position whereby the locking surfaces 42 of the fingers 40 serve to releasably hold the flange 25 in position. Moreover, the camming surfaces 41 render it easier to manually bias the shoulders 36 out of position to facilitate removal of the connector 20 when so desired.

To complete the description of the connector clip, it should be observed that each clip 30 includes an abutment flange 38 extending from body member 31 in a direction opposite to the direction of said engagement surfaces 33 and 34, and defining a surface substantially parallel to the mounting surface 35 such that, when the clips are in position, the abutment flange 38 extends into the aperture 15 of the associated panel board so as to slightly constrict the size of the aperture. As best observed in FIG. 3, the body portion 21 of connector 20 includes a shoulder portion 28 thereon which cooperates with the abutment flange 38 to captivate the clip in a wedged position on the panel board and to preclude inward movement of the connector 20 relative to the panel board aperture.

Installation of the connector assembly may be simply accomplished by inserting a pair of the connector clips 30 into an aperture 15 in the panel board and mounting each clip to the panel on the opposite sides of the aperture. The connector 20 is then assembled in the opening between the clips 30 by placing the main body portion 21 thereof into the opening and wedging the surfaces thereof against the cooperating surfaces of the clips 30. With the shoulder portion 28 in engagement with the abutment flange 38 of the clip, further inward movement of the connector 20 relative to the panel board is precluded; also, with the connector body portion in the opening, the connector clips 30 are fixedly held in position relative to the panel board.

As the connector is forced into the opening, its mounting flanges 25 engage the camming surfaces 41 on the retaining fingers 40 and force shoulders 36 outwardly until such time as the mounting flanges are disposed below the locking surfaces 42 on the retaining fingers 40, after which the shoulders snap back to a non-stress position. It will be observed that the configuration of the clips allows for slight deviations in aperture size and moreover, they can accommodate connectors of different longitudinal extent so long as the connector and aperture are substantially cooperable in overall dimension.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. An electrical connector assembly adapted to be mounted in an opening of an associated apertured panel board having inner and outer surfaces, said assembly including an electrical connector including a body portion adapted to extend partially through the aperture and a pair of outwardly extending mounting flanges at opposite ends of said body portion and a pair of connector clips for securing said electrical connector to the associated apertured support panel, each of said clips comprising:

a body member having first and second spaced surfaces disposed generally in facing relationship with each other to define a panel mounting slot;

said body member receivable in the aperture of the associated support panel with said support panel extending into said slot;

said body member having a mounting surface for receiving and holding one of said flanges on one end of said electrical connector;

a pair of spaced abutment shoulders projecting from said mounting surface and serving to limit movement of said electrical connector when a flange thereof is juxtaposed with said mounting surface and within the cavity defined by said abutment shoulders;

retaining fingers carried by said abutment shoulders for releasably securing said flange of said connector to said mounting surface, whereby, upon insertion of the pair of said clips into opposite ends of the aperture in said panel board and placing said body portion of said connector through the aperture, said body portion serves to retain said pair of clips in fixed position on the panel board while said mounting flanges of said connector are retained in position on said mounting surfaces so that said connector is fixedly secured to said clips; and an abutment flange defining an abutment flange surface substantially parallel to said mounting surface of each said clip and adapted to extend into the aperture of the associated panel board to constrict the size of said aperture, and said connector body portion including a shoulder portion adapted to cooperate with said abutment flange to further hold said clips on the panel board and to further preclude movement of said connector relative to said panel.

2. The electrical connector assembly set forth in claim 1, wherein said retaining arms are integrally formed with said abutment shoulders.

3. The electrical connector assembly set forth in claim 2, wherein said shoulders are resilient and each includes a camming surface and an underlying locking surface, said camming surfaces facilitating outward movement of said shoulders when a respective flange of said connector is pressed thereagainst, said shoulders snapping back after said flange overrides said camming surfaces so that said locking surfaces serve to hold said flange onto said mounting surface.

4. The electrical connector assembly set forth in claim 1, wherein said first surface on each clip comprises three spaced-apart arms formed on said body member and adapted to engage the inner surface of the associated support panel at laterally spaced portions thereof to provide stabilized connector retaining cooperation with said second surface overlying the outer surface of the associated support panel.

5. The electrical connector assembly set forth in claim 4, wherein said retaining arms are laterally spaced across the width of said connector clip.

6. The electrical connector assembly set forth in claim 1, wherein each of said clips includes a second pair of abutment shoulders disposed in opposite parallel position on the periphery of said mounting surface and at an angle to said first pair of abutment shoulders to further preclude movement of the said connector.

7. The electrical connector assembly set forth in claim 1, wherein each of said clips is formed of a dielectric material to electrically isolate the connector from the associated panel board.

8. A connector clip for use in an electrical connector assembly for securing an electrical connector to an associated apertured support panel having inner and outer surfaces, said clip comprising:

a body member having first and second spaced engagement surfaces disposed generally in facing relationship to define a panel mounting slot, said first surface comprising a plurality of spaced arms formed on said body member and adapted to cooperate with the inner surface of the associated support panel at laterally spaced portions thereof;

said body member receivable in an aperture in the associated support panel with said support panel extending into said slot;

said body member having a mounting surface for receiving and supporting a complementary flange of said electrical connector;

a pair of spaced abutment shoulders extending outwardly from said mounting surface and diverging angularly toward said electrical connector serving to limit movement of said electrical connector when the flange thereof is juxtaposed with said mounting surface and within the cavity defined by said abutment shoulders;

retaining fingers carried by said abutment shoulders for releasably securing the flange of the associated electrical connector to said mounting surface; and an abutment flange extending outwardly therefrom in a direction opposite to said engagement surfaces and defining a flange surface substantially parallel to said mounting surface and adapted to extend into the aperture of the associated panel to constrict the size of said aperture and to preclude movement of said connector therethrough.

* * * * *